US006877814B2

(12) United States Patent
Lin

(10) Patent No.: US 6,877,814 B2
(45) Date of Patent: Apr. 12, 2005

(54) CHAIR DEVICE

(76) Inventor: Chen-Hsiung Lin, 58 Ma Yuan West St., Taichung (TW)

( * ) Notice: Subject to any disclaimer, the term of this patent is extended or adjusted under 35 U.S.C. 154(b) by 170 days.

(21) Appl. No.: 10/395,414

(22) Filed: Mar. 21, 2003

(65) Prior Publication Data

US 2004/0195896 A1 Oct. 7, 2004

(51) Int. Cl.[7] ..... A47C 7/00; A47C 7/02

(52) U.S. Cl. ..... 297/440.24; 297/440.22; 297/440.1

(58) Field of Search ..... 297/440.1, 440.24, 297/440.2, 445.1, 448.1, 440.22

(56) References Cited

U.S. PATENT DOCUMENTS 3,180,685 A * 4/1965 Rogalski et al. ..... 297/440.24
4,784,436 A * 11/1988 Sutherland ..... 297/440.24
5,180,208 A * 1/1993 Lawandi ..... 297/440.24 X
6,039,403 A * 3/2000 Hargroder ..... 297/440.24 X
6,122,776 A * 9/2000 Cheng ..... 4/578.1

* cited by examiner

*Primary Examiner*—Anthony D. Barfield

(57) ABSTRACT

A chair device has a support frame and a seat disposed on the support frame. The support frame has a first U-shaped leg, a second U-shaped leg, a pipe connected to the first U-shaped leg and the second U-shaped leg, a tube connected to the first U-shaped leg and the second U-shaped leg, a first confining rod disposed on the first U-shaped leg and the second U-shaped leg, and a second confining rod disposed on the first U-shaped leg and the second U-shaped leg. The seat has a first metal ring, a second metal ring, a third metal ring, and a plurality of bands. The bands are sewed with the first metal ring, the second metal ring, and the third metal ring radially.

4 Claims, 7 Drawing Sheets

CHAIR DEVICE

BACKGROUND OF THE INVENTION

The present invention relates to a chair device. More particularly, the present invention relates to a chair device which is easily detached, carried, and assembled.

A conventional chair is often made of wood or metal. The conventional chair has a plurality of elements which are fixed together. Another conventional chair has many detachable parts. However, it is cumbersome to assemble the detachable parts following an instruction manual.

SUMMARY OF THE INVENTION

An object of the present invention is to provide a chair device which is easily detached and carried.

Another object of the present invention is to provide a chair device which is easily assembled.

Another object of the present invention is to provide a chair device which has a plurality of metal rings and a plurality of bands to be sewed with the metal rings to form a seat in order to receive a cushion so that a user will use the chair device comfortably.

Accordingly, a chair device comprises a support frame and a seat disposed on the support frame. The support frame has a first U-shaped leg, a second U-shaped leg, a pipe connected to the first U-shaped leg and the second U-shaped leg, a tube connected to the first U-shaped leg and the second U-shaped leg, a first confining rod disposed on the first U-shaped leg and the second U-shaped leg, and a second confining rod disposed on the first U-shaped leg and the second U-shaped leg.

In accordance with a first preferred embodiment of the present invention, a seat has a first metal ring, a second metal ring, a third metal ring, and a plurality of bands. The second metal ring surrounds the third metal ring. The first metal ring surrounds the second metal ring. The bands are sewed with the first metal ring, the second metal ring, and the third metal ring radially. Each of the bands is made of a fabric material.

In accordance with a second preferred embodiment of the present invention, a seat has a first metal ring, a second metal ring, a plurality of bands, and a two-ply fabric. The first metal ring surrounds the second metal ring. The bands are sewed with the first metal ring radially. The two-ply fabric is sewed with the second metal ring. Each of the two-ply fabric has a plurality of openings and each of the openings receives the corresponding band.

In accordance with a third preferred embodiment of the present invention, a seat has a metal ring and a fabric. The fabric is sewed with the metal ring. The fabric has a plurality of openings.

DETAILED DESCRIPTION OF THE INVENTION

Figure 1:
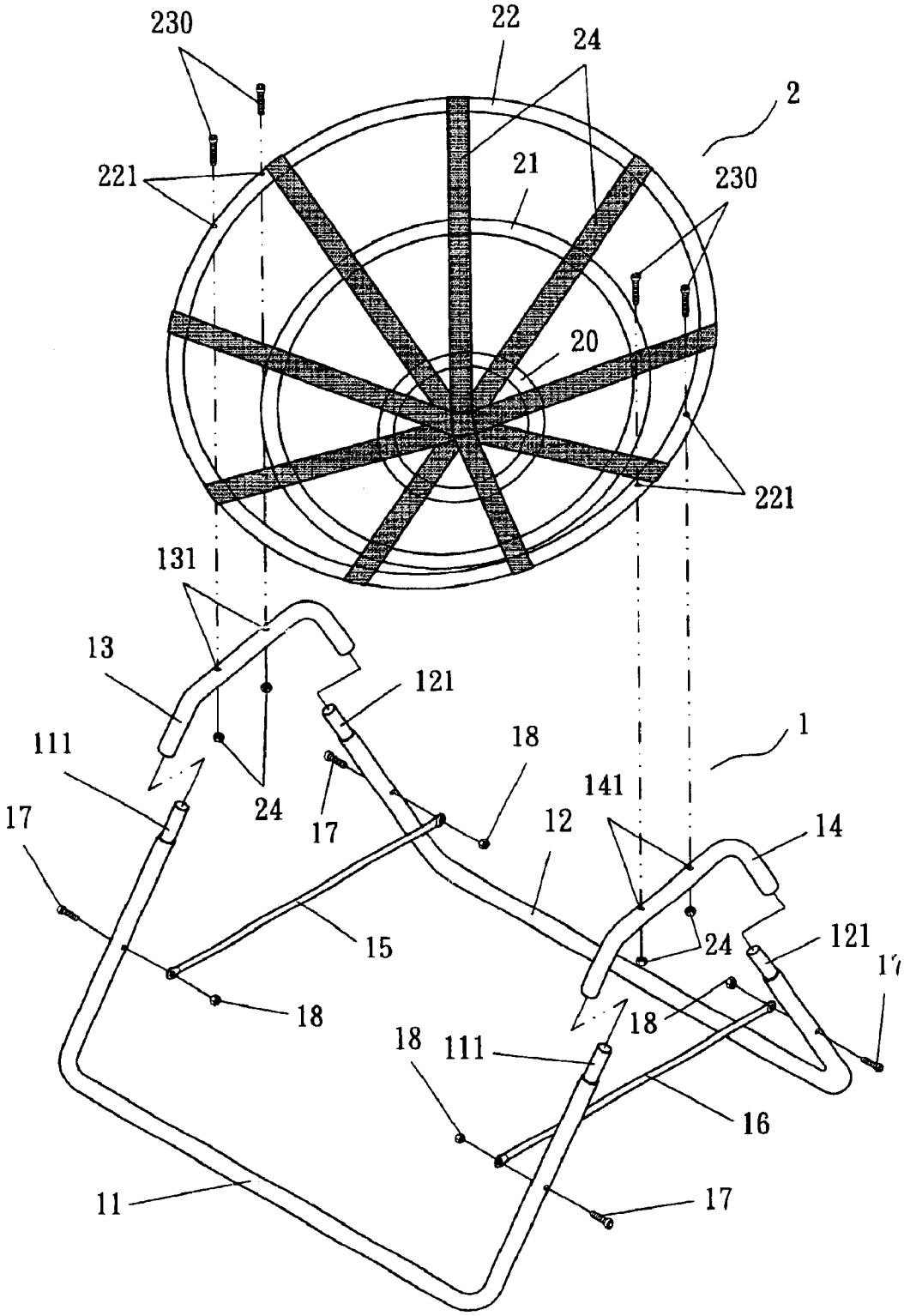
FIG. 1 is a perspective exploded view of a chair device of a first preferred embodiment in accordance with the present invention.
Figure 2:
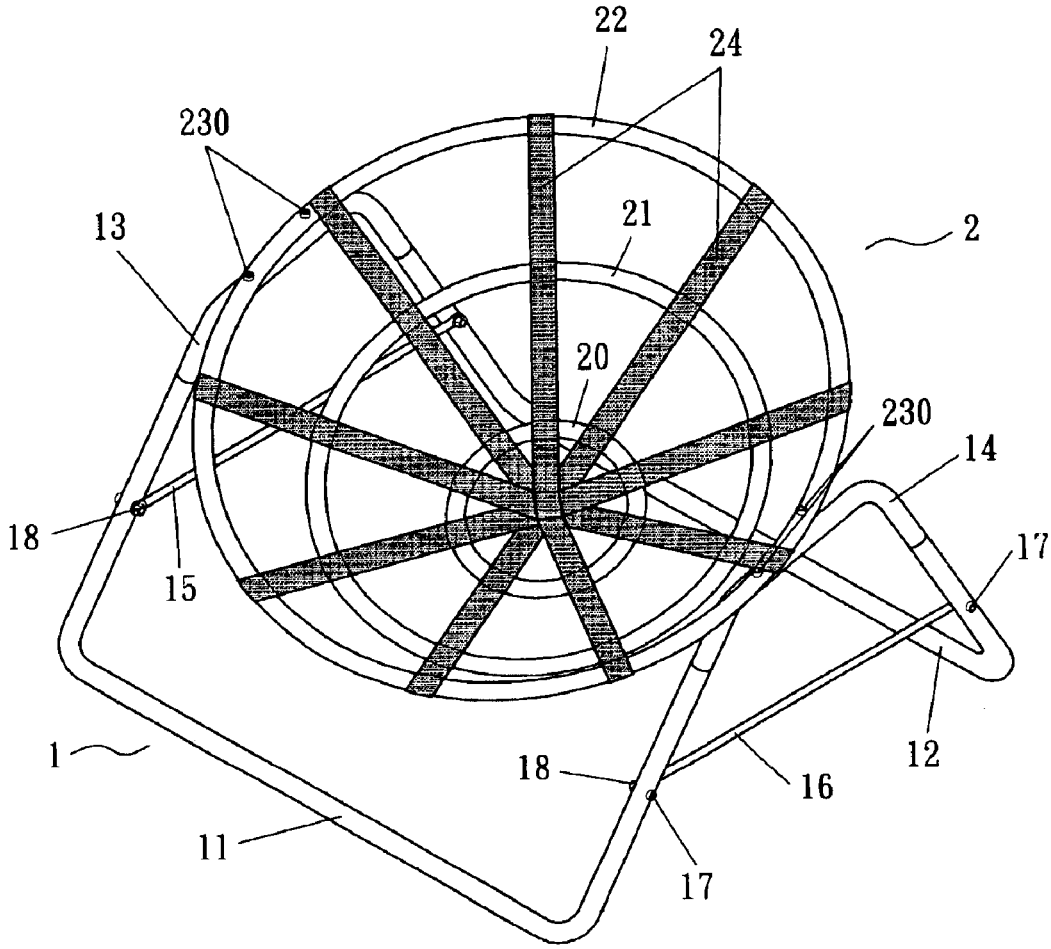
FIG. 2 is a perspective assembly view of a chair device of a first preferred embodiment in accordance with the present invention.
Figure 3:
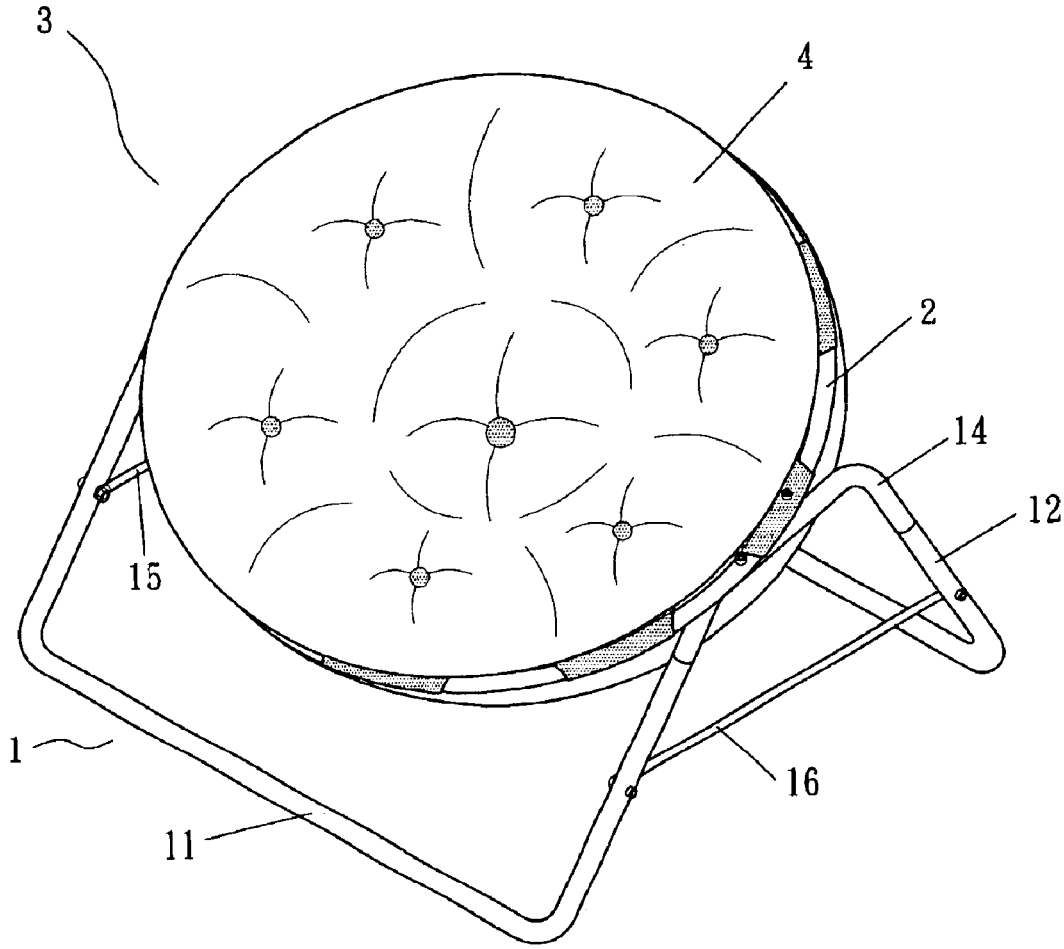
FIG. 3 is a perspective view of a chair device of a first preferred embodiment with a cushion.

Referring to FIGS. 1 to 3, a first chair device 3 comprises a support frame 1 and a seat 2 disposed on the support frame 1.

The support frame 1 has a first U-shaped leg 11, a second U-shaped leg 12, a pipe 13 connected to the first U-shaped leg 11 and the second U-shaped leg 12, a tube 14 connected to the first U-shaped leg 11 and the second U-shaped leg 12, a first confining rod 15 disposed on the first U-shaped leg 11 and the second U-shaped leg 12, and a second confining rod 16 disposed on the first U-shaped leg 11 and the second U-shaped leg 12.

The first U-shaped leg 11 has a pair of connection end rods 111 inserted in the pipe 13 and the tube 14.

The second U-shaped leg 12 has a pair of connection end bars 121 inserted in the pipe 13 and the tube 14.

The pipe 13 has a plurality of through holes 131.

The tube 14 has a plurality of through apertures 141.

A plurality of screws 17 and nuts 18 fasten the first confining rod 15 and the first U-shaped leg 11, the first confining rod 15 and the second U-shaped leg 12, the second confining rod 16 and the first U-shaped leg 11, and the second confining rod 16 and the second U-shaped leg 12.

The seat 2 has a first metal ring 22, a second metal ring 21, a third metal ring 20, and a plurality of bands 24.

The second metal ring 21 surrounds the third metal ring 20.

The first metal ring 22 surrounds the second metal ring 21.

The bands 24 are sewed with the first metal ring 22, the second metal ring 21, and the third metal ring 20 radially.

Each of the bands 24 is made of a fabric material.

The first metal ring 22 has a plurality of round holes 221 to match the through holes 131 of the pipe 13 and the through apertures 141 of the tube 14.

A plurality of bolts 230 and nuts 24 fasten the first metal ring 22 and the pipe 13, and the first metal ring 22 and the tube 14.

A cushion 4 is disposed on the seat 2.

Figure 4:
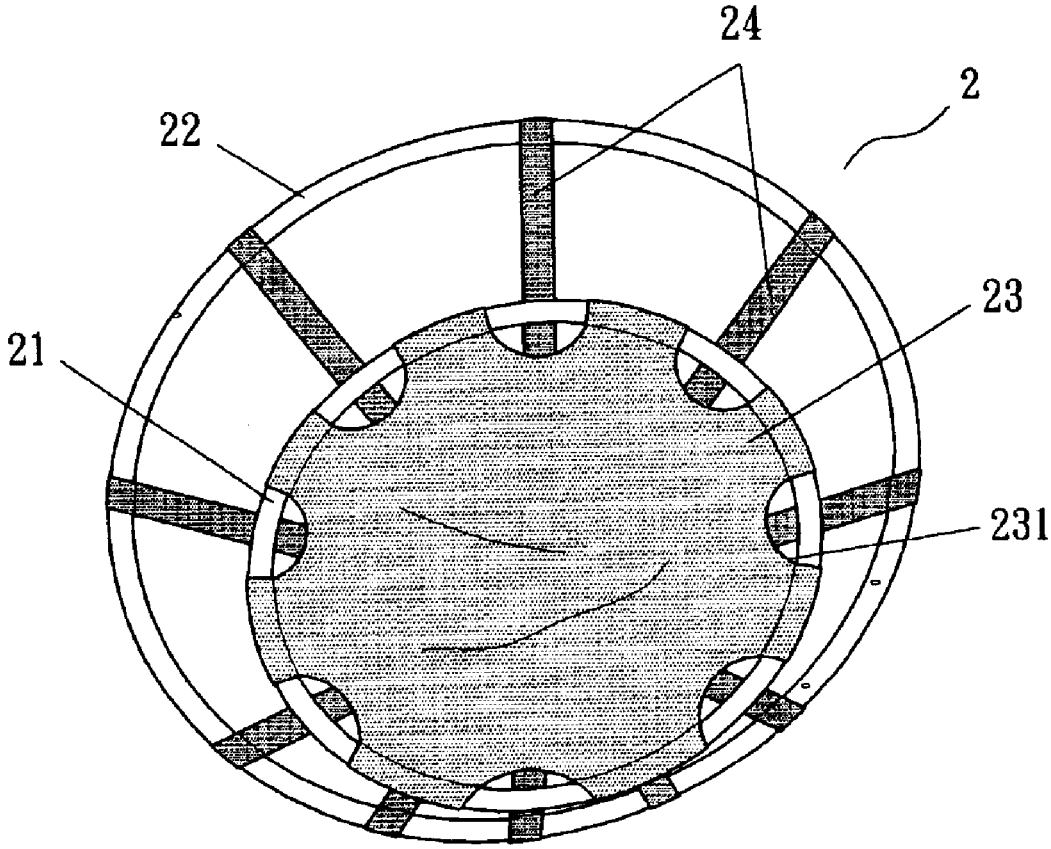
FIG. 4 is a perspective view of a seat of a second preferred embodiment in accordance with the present invention.
Figure 5:
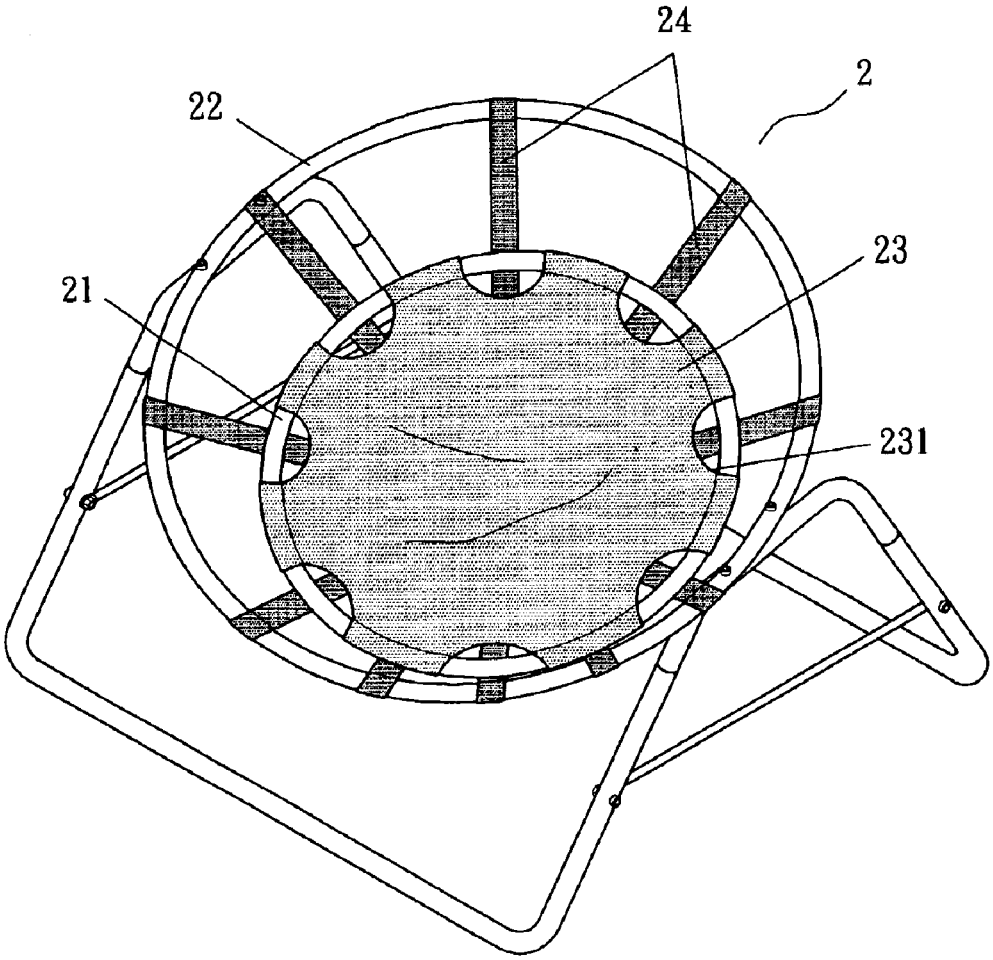
FIG. 5 is a perspective assembly view of a chair device of a second preferred embodiment in accordance with the present invention.

Referring to FIGS. 4 and 5, a second seat 2 has a first metal ring 22, a second metal ring 21, a plurality of bands 24, and a two-ply fabric 23.

The first metal ring 22 surrounds the second metal ring 21.

The bands 24 are sewed with the first metal ring 22 radially.

The two-ply fabric 23 is sewed with the second metal ring 21.

Each of the two-ply fabric 23 has a plurality of openings 231 and each of the openings 231 receives the corresponding band 24.

Figure 6:
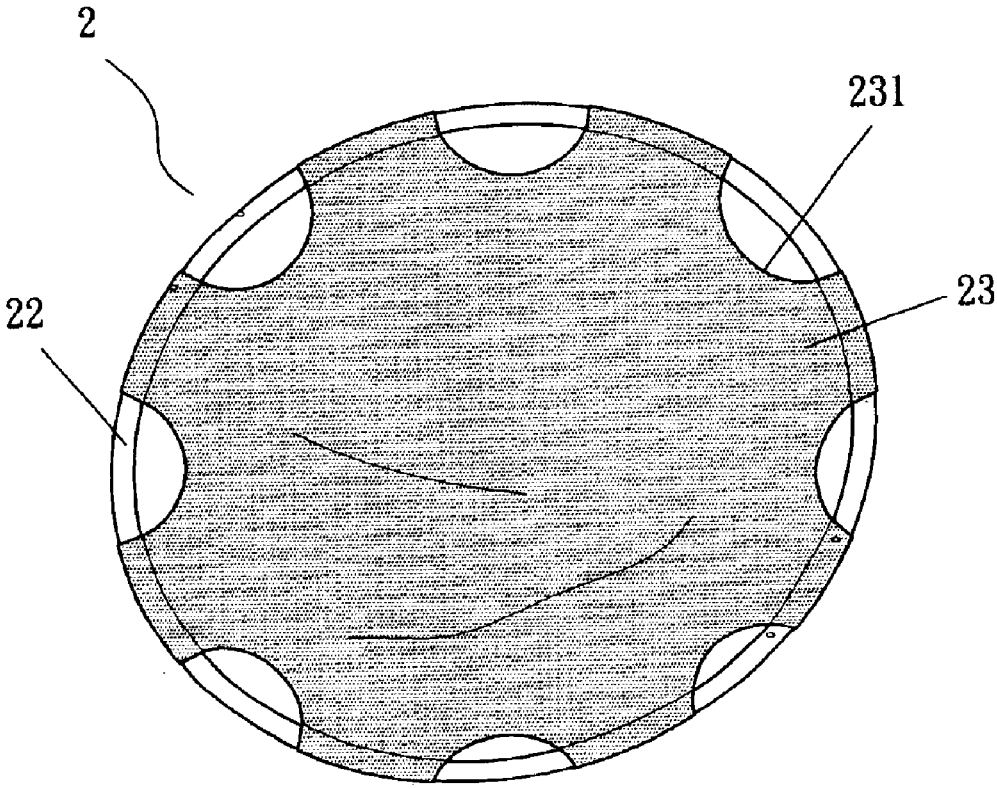
FIG. 6 is a perspective view of a seat of a third preferred embodiment in accordance with the present invention.
Figure 7:
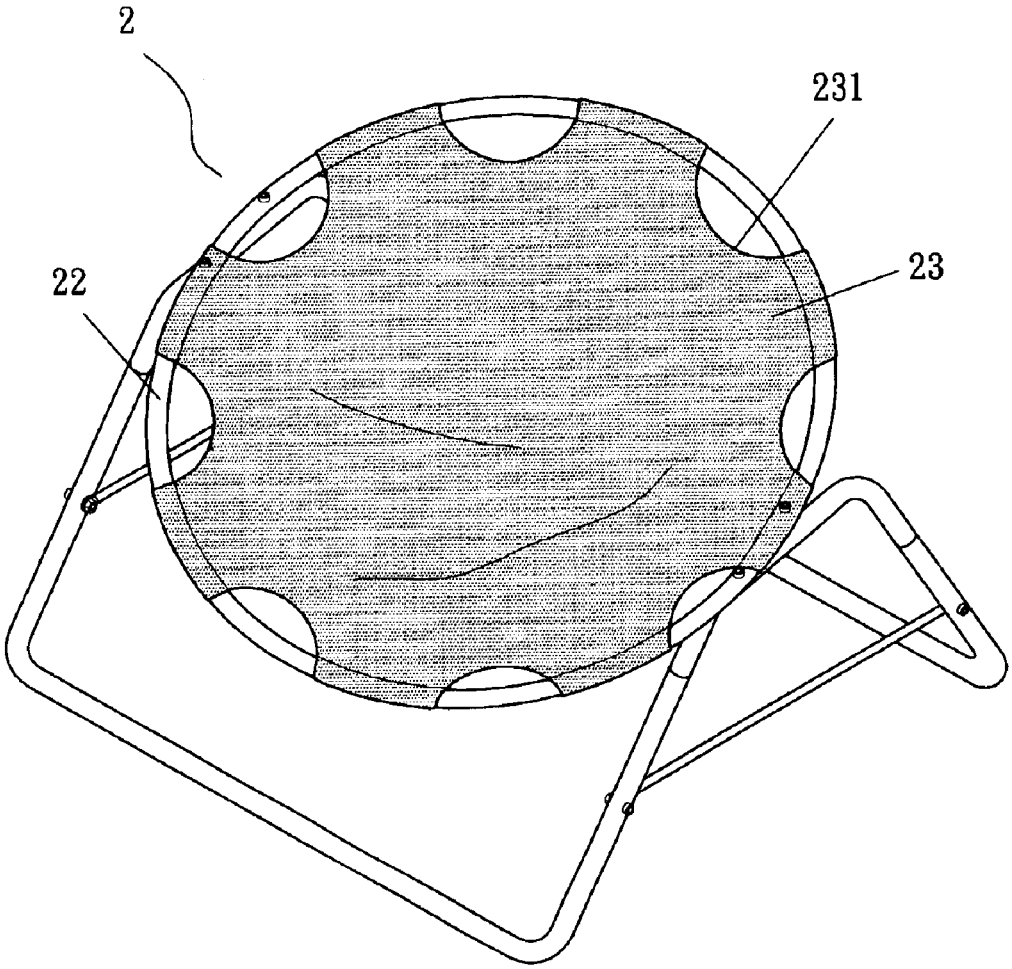
FIG. 7 is a perspective assembly view of a chair device of a third preferred embodiment in accordance with the present invention.

Referring to FIGS. 6 and 7, a third seat 2 has a metal ring 22 and a fabric 23. The fabric 23 is sewed with the metal ring 22. The fabric 23 has a plurality of openings 231.

The present invention has the following advantages. The chair device is easily detached and carried. The chair device is easily assembled. The chair device has a plurality of metal rings and a plurality of bands to be sewed with the metal rings to form the seat in order to receive the cushion so that a user will use the chair device comfortably.

The present invention is not limited to the above embodiments but various modification thereof may be made. Furthermore, various changes in form and detail may be made without departing from the scope of the present invention.

I claim:

1. A chair device comprises:

a support frame and a seat disposed on the support frame, the support frame having a first U-shaped leg, a second U-shaped leg, a pipe connected to the first U-shaped leg and the second U-shaped leg, a tube connected to the first U-shaped leg and the second U-shaped leg, a first confining rod disposed on the first U-shaped leg and the second U-shaped, leg, and a second confining rod disposed on the first U-shaped leg and the second U-shaped leg wherein:

the seat has a first metal ring, a second metal ring, a third metal ring and a plurality of bands, the second metal ring surrounds the third metal ring, the first metal ring surrounds the second metal ring, and the bands are sewed with the first metal ring, the second metal ring and the third metal rind radially.

2. The chair device as claimed in claim 1, wherein the first U-shaped leg has a pair of connection end rods inserted in the pipe and the tube, and the second U-shaped leg has a pair of connection end rods inserted in the pipe and, the tube.

3. A chair device comprises:

a support frame and a seat disposed on the support frame, the support frame having a first U-shaped leg, a second U-shaped leg, a pipe connected to the first U-shaped leg and the second U-shaped leg, a tube connected to the first U-shaped leg and the second U-shaped leg, a first confining rod disposed on the first U-shaped leg and the second U-shaped leg, and a second confining rod disposed on the first U-shaped leg and the second U-shaped leg, wherein the seat has a first metal ring, a second metal ring, a plurality of bands and a two-ply fabric, the first metal ring surrounds the second metal ring, the bands are sewed with the first metal ring radially, the two-ply fabric is sewed with the second metal ring, the two-ply fabric has a plurality of openings, and each of the openings receives the corresponding band.

4. A chair device comprises;

a support frame and a seat disposed on the support frame, the support frame having a first U-shaped leg, a second U-shaped leg, a pipe connected to the first U-shaped leg and the second U-shaped leg, a tube connected to the first U-shaped leg and the second U-shaped leg, a first confining rod disposed on the first U-shaped leg and the second U-shaped leg, and a second confining rod disposed on the first U-shaped leg and the second U-shaped leg, wherein the seat has a metal ring and a fabric, the fabric is sewed with the metal ring, and the fabric has a plurality of openings.

* * * * *